US011821618B2

(12) United States Patent
Tress et al.

(10) Patent No.: US 11,821,618 B2
(45) Date of Patent: Nov. 21, 2023

(54) ROTATABLE SHELF ILLUMINATION SYSTEM

(71) Applicant: Rev-A-Shelf Company, LLC, Louisville, KY (US)

(72) Inventors: Christopher Michael Tress, Louisville, KY (US); Andrew Logan Silvers, Jeffersonville, IN (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 0 days.

(21) Appl. No.: 17/539,985

(22) Filed: Dec. 1, 2021

(65) Prior Publication Data

US 2023/0167972 A1 Jun. 1, 2023

(51) Int. Cl.

| | |
|---|---|
| ***F21V 33/00*** | (2006.01) |
| ***F21V 5/04*** | (2006.01) |
| ***F21S 9/02*** | (2006.01) |
| ***F21V 23/04*** | (2006.01) |
| ***F21V 23/00*** | (2015.01) |
| ***A47B 49/00*** | (2006.01) |
| ***A47B 63/00*** | (2006.01) |
| ***A47B 63/06*** | (2006.01) |

(52) U.S. Cl.

CPC ..... *F21V 33/0012* (2013.01); *F21S 9/02* (2013.01); *F21V 5/04* (2013.01); *F21V 23/003* (2013.01); *F21V 23/0442* (2013.01); *A47B 49/004* (2013.01); *A47B 49/006* (2013.01); *A47B 63/062* (2013.01); *A47B 2063/005* (2013.01); *A47B 2220/0075* (2013.01); *A47B 2220/0077* (2013.01); *F21V 23/0492* (2013.01)

(58) Field of Classification Search

CPC ..... F21V 33/0012; F21V 5/04; F21V 23/003; F21V 23/0442; F21V 23/0492; F21S 9/02; A47B 49/004; A47B 49/006; A47B 63/062; A47B 2063/005; A47B 2220/0075; A47B 2220/0077

See application file for complete search history.

(56) References Cited

U.S. PATENT DOCUMENTS

| | | | | |
|---|---|---|---|---|
| 6,231,205 | B1 * | 5/2001 | Slesinger | A47B 97/00 362/225 |
| 6,932,488 | B1 * | 8/2005 | Horn | A47G 1/02 362/128 |
| 7,144,139 | B2 * | 12/2006 | Kramer | E04F 19/06 362/240 |
| 7,891,841 | B2 * | 2/2011 | Levine | F21S 9/03 362/249.02 |

(Continued)

*Primary Examiner* — Tsion Tumebo

(74) *Attorney, Agent, or Firm* — Crowell & Moring LLP

(57) ABSTRACT

A rotatable shelf illumination system may include a rotatable shelf having a groove in which one or more light sources may be mounted. A refractive lens may be mounted in the groove covering the one or more light sources. The rotatable shelf may be, for example, a lazy susan. A removeable and rechargeable power supply may be controlled by a controller circuitry to selectively energize the one or more light sources when rotation of the rotatable shelf is detected. A magnetic field sensor may be used with the controller circuitry to detect rotational movement of the rotatable shelf. The controller circuitry may implement energy conservation measures to prolong the charge of the rechargeable power supply.

21 Claims, 7 Drawing Sheets

(56) References Cited

U.S. PATENT DOCUMENTS

| | | | | |
|---|---|---|---|---|
| 8,562,167 | B1 * | 10/2013 | Meier | F21V 33/0012 362/125 |
| 9,775,447 | B2 * | 10/2017 | Wiemer | A47F 5/103 |
| 10,330,375 | B2 * | 6/2019 | Lee | H01H 9/085 |
| 10,743,665 | B1 * | 8/2020 | Heroux | F16B 47/006 |
| 10,939,535 | B1 * | 3/2021 | Ghahramani | F21V 23/0442 |
| 11,236,896 | B1 * | 2/2022 | Schiel | F21S 4/28 |
| 2006/0169187 | A1 * | 8/2006 | Hoffman | A47B 49/006 108/103 |
| 2011/0273867 | A1 * | 11/2011 | Horst | A47B 97/00 362/133 |
| 2014/0184069 | A1 * | 7/2014 | Hollaway | F21S 9/02 362/249.02 |
| 2016/0367026 | A1 * | 12/2016 | Hall | A47B 81/04 |
| 2017/0205138 | A1 * | 7/2017 | Hwang | G06Q 10/087 |
| 2017/0363276 | A1 * | 12/2017 | Chien | F21V 5/04 |
| 2018/0245786 | A1 * | 8/2018 | Fujiwara | A47B 67/005 |
| 2018/0283668 | A1 * | 10/2018 | Conrady | A47B 77/08 |
| 2019/0113215 | A1 * | 4/2019 | Coleman | F21V 23/0471 |
| 2019/0261788 | A1 * | 8/2019 | Ringel | F21S 8/033 |

* cited by examiner

ROTATABLE SHELF ILLUMINATION SYSTEM

FIELD

The present disclosure relates generally to shelf illumination, and more particularly to a rotatable shelf illumination system.

BACKGROUND

Cabinets, such as vanity or kitchen cabinets include drawers and various shapes of cavities in which shelves may be installed. In some cabinet designs, different kinds of shelf designs may be used. One type of shelf design is referred to as a "lazy susan." A lazy susan may include one or more shelves mounted on a central pole that a user may rotate to access materials stored on the shelf(s). Depending on the level of lighting external to the cabinet, it may be difficult to ascertain what materials are stored on a respective shelf.

SUMMARY

Further areas of applicability will become apparent from the description provided herein. It should be understood that the description and specific examples are intended for purposes of illustration only and are not intended to limit the scope of the present disclosure.

In an example, a rotatable shelf illumination system includes an electronics enclosure mountable on a rotatable shelf in a cabinet. The system may also include a series of sequentially mounted light sources, such as light emitting diodes (LEDs). The light sources may be mounted in a groove formed around a circumferential outer or inner edge of the rotatable shelf. The light sources may be electrically coupled with a rechargeable power supply included in the electronics enclosure. A refractive lens may be mounted in the groove formed around the circumferential edge of the rotatable shelf as a cover over the light sources.

The rotatable shelf illumination system may include a magnetic field sensor included in the electronics enclosure and powered by the rechargeable power supply. The magnetic field sensor may measure a magnetic field, which may be used by a controller circuitry to determine a rotational position of the rotatable shelf and determine a heading. The controller circuitry may be included in the electronics enclosure and powered by the rechargeable power supply. The controller circuitry may monitor the magnetic field sensor for a rotational position of the rotatable shelf and energize the flexible circuit board with the rechargeable power supply for a predetermined period of time in response to changes in a rotational position of the rotatable shelf.

An interesting feature of the rotatable shelf illumination system relates to the adjustability of a sensitivity of the controller circuitry to detect an amount of rotation of the rotatable shelf and energize the light source.

Another interesting feature of the rotatable shelf illumination system relates to the magnetic field sensor and the controller circuitry being automatically awakened from a sleep mode upon detection of motion, and, a current home position of the rotatable shelf may be established. The controller circuitry may energize the light sources in response to rotation of the rotatable shelf greater than a predetermined amount, based on the current home position. The magnetic field sensor and the controller circuitry may return to the sleep mode after a predetermined time, and the magnetic field sensor and the controller circuitry may be later re-awakened, upon subsequent movement of the rotatable shelf, and calibrated to a new current home position.

DRAWINGS

The embodiments may be better understood with reference to the following drawings and description. The components in the figures are not necessarily to scale. Moreover, in the figures, like-referenced numerals designate corresponding parts throughout the different views.

FIG. 1 an example of a rotatable shelf illumination system.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
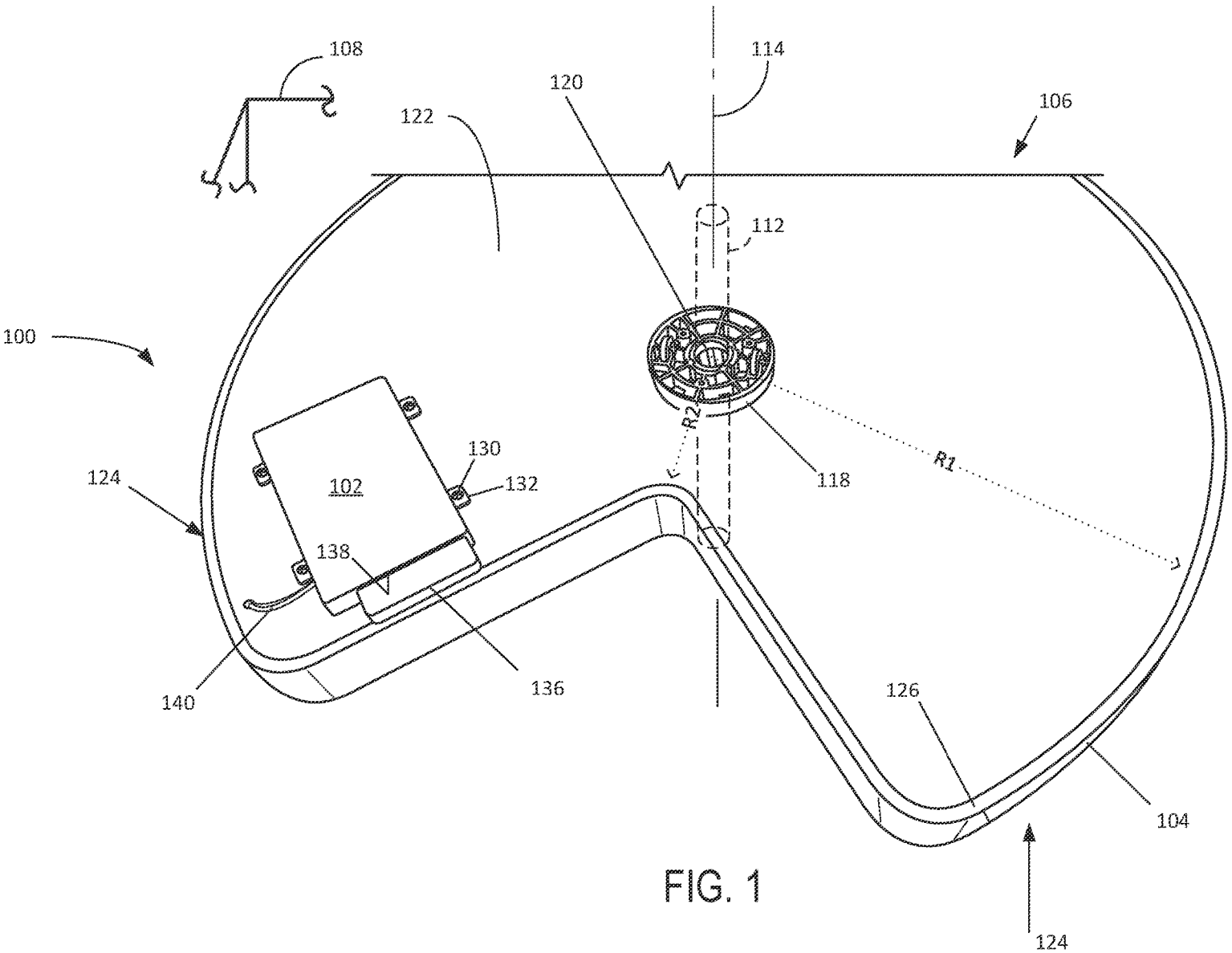

Referring to FIG. 1, an example of a rotatable shelf illumination system 100 is illustrated. The rotatable shelf illumination system 100 includes an electronics enclosure 102 and one or more light sources 104 mountable on a rotatable shelf 106 in a cabinet 108. The one or more light sources 104 may be a series of sequentially aligned light sources mounted along an outer edge of the rotatable shelf 106. The one or more light sources may be, for example, light emitting diodes (LEDs), chip-on-board (COB) LEDs, organic LEDs (OLEDs), electroluminescence material, or any other material or device capable of being mounted on the rotatable shelf 106 and emitting light when energized. In an example, the one or more light sources 104 may be a series of sequentially mounted individual light sources.

The cabinet 108 may be an enclosure, such as a kitchen cabinet or vanity cabinet made of a rigid material such as wood or plastic, sized to receive and mount at least one rotatable shelf 106. The rotatable shelf 106 may be coaxially coupled with a central post 112 mounted in the cabinet 108 at the top and/or the bottom of the cabinet 108 such that the rotatable shelf 106 is rotatable about a central axis 114 of the central post 112 and the rotatable shelf 106. In FIG. 1, a bottom perspective view of the rotatable shelf 106 is illustrated.

The rotatable shelf 106 may be constructed of wood and/or plastic or some other rigid material, and may extend radially outward from the central axis 114. A collar 118 may be included on the rotatable shelf 106. The collar 118 may include a central aperture 120 sized to receive the central post 112 such that the collar 118 is coaxially positioned on the central axis 114. The collar 118 may be coupled to the central post 112, which may be rotatable on bearings, slides, or some other configuration that allows low friction rotation of the central post 112 and correspondingly the rotatable shelf 106. Alternatively, the central post 112 may be fixed in the cabinet 108, and the collar 118 may be rotatable about the central post 112 so as to correspondingly rotate the rotatable shelf 106. In other examples, the collar 118 may be omitted and one or more central posts 112 may be coupled with and rotatably maintain the rotatable shelf 106 in the cabinet 108. In addition, any number of rotatable shelves 106 may be mounted on one or more of the central post(s) 112. Also, each rotatable shelf 106 may have a separate and independent central post 112 mounted in the cabinet 108. In the case of multiple independently rotatable rotating shelves 106, multiple rotatable shelf illumination systems 100 may be used.

The rotatable shelf 106 may radially extend away from the central axis 114 as a planar surface 122 to a peripheral outer edge 124 circumferentially surrounding at least part of the rotatable shelf 106. A lip 126 may be included at the peripheral outer edge 124. The lip 126 may abut and extend perpendicularly away from at least one of the opposing planar surfaces of the rotatable shelf 106. The rotatable shelf 106 may be a shelf in the shape of, for example, a full circle shelf, a "D shaped" shelf, a pie cut shelf, a kidney shaped shelf, or any other shelf configuration that is rotatable within the cabinet 108. In the example of FIG. 1, the rotatable shelf 106 is illustrated as a kidney shaped shelf, and the planar surface 122 extends radially away from central axis 114 a predetermined radius R1 to the lip 126 except the portion of the rotatable shelf 106 where a triangular shaped portion of the planar surface 122 is omitted and the lip 126 becomes radially closest to the central axis 114 at a predetermined radius R2.

The electronics enclosure 102 may be plastic, wood, or some other ridged material that is mounted on the planar surface 122 of the rotatable shelf 106. In the example of FIG. 1, the electronic enclosure 102 is mounted on a bottom, or backside planar surface 122 of the rotatable shelf 106 with fasteners 130, such as wood screws coupling ears 132 of the electronic enclosure 102 to the planar surface 122. The electronics enclosure 102 may include a rechargeable power supply 136 in a slot 138 in the electronics enclosure 102. The rechargeable power supply 136 may be removeable from the slot 138, and may supply power to the electronics enclosure 102. The rechargeable power supply 136 may selectively supply power to the flexible circuit board 114 via conductors 140. The conductors 140 may be wires or other conductive material surrounded by insulation capable of carrying control signals and/or power signals to control operation of the one or more light sources 104.

The rechargeable power supply 136 may be a rechargeable energy storage device, such as a battery power brick, that is removable from the electronics enclosure 102. The rechargeable power supply 136 may be recharged by being electrically connected with an external power supply, such as by placing the rechargeable power supply 136 in a cradle, or wire connecting the rechargeable power supply 136 to an external power source, such as 120 Vac or 5 Vdc. After recharging, the rechargeable power supply 136 may be reinserted into the electronics enclosure 102.

Figure 2:
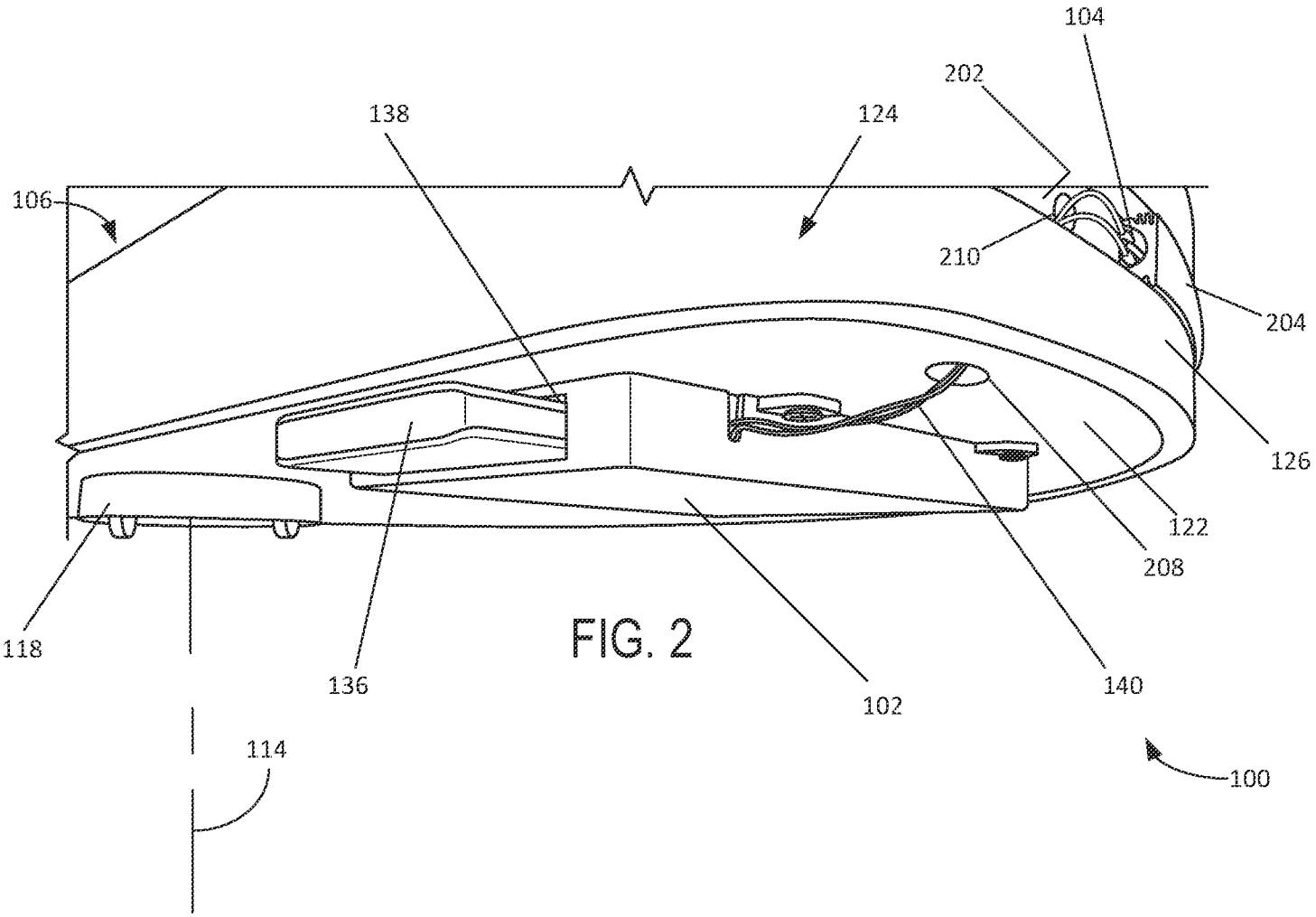
FIG. 2 is a perspective view of another example rotatable shelf illumination system.

FIG. 2 is a perspective view of another example of a rotatable shelf illumination system 100. Features and functionality discussed with reference to FIG. 1 are fully compatible and interchangeable, unless otherwise indicated. Accordingly, for purposes of brevity, the previous discussion will not be repeated, and the further discussion herein will instead highlight features and functionality illustrated in FIG. 2. In FIG. 2, a portion of a rotatable shelf 106 from FIG. 1 is illustrated from a side view with the central axis 114, collar 118, planar surface 122 and the lip 126 at the peripheral edge of the rotatable shelf 106 shown. As further illustrated in FIG. 2, the electronics enclosure 102 is mounted on the planar surface 122 such that the rechargeable power supply 136 is readily removeable from the slot 138 by a user reaching into the cabinet, grasping an exposed end of the rechargeable power supply 136, and applying a withdrawal force to electrically disconnect and physically extract the rechargeable power supply 136 from the electronics enclosure 102.

As also illustrated in FIG. 2, the one or more light sources 104 are mounted in a groove 202 formed in the lip 126 positioned at the circumferential edge of the rotatable shelf 106. The groove 202 may be formed in a radially outward surface of the lip 126, or a radially inward surface of the lip 126, at the circumferential outer edge 124 of the rotatable shelf 106. In examples, the groove 202 may extend radially inward where the groove 202 is formed in the radially outward surface of the lip 126, or radially outward where the groove 202 is formed in the radially inward surface of the lip 126. The groove 202 may extend into the lip 126 about 6-10 mm, for example, so as to be able to fully accommodate installation of the one or more light sources 104 therein. The one or more light sources 104 may be recessed within the groove 202. A refractive lens 204 is mounted in the groove 202 formed around the circumferential edge 124 of the rotatable shelf 106. The refractive lens 204 may be a lens and/or diffuser providing transmission of light and operating as a cover over the one or more light sources 104. The refractive lens 204 may be any flexible material, such as silicone or plastic, having refractive properties and/or diffusing properties, and be capable of being mounted in the groove 202. In the illustrated example, the refractive lens 204 may be held in the groove 202 by friction fit. The power supply line 140 may be routed through an entry aperture 208 in the planar surface 122 and emerge from an exit aperture 210 in the groove 202 to electrically connect the electronics enclosure 102 and the one or more light sources 104.

Figure 3:
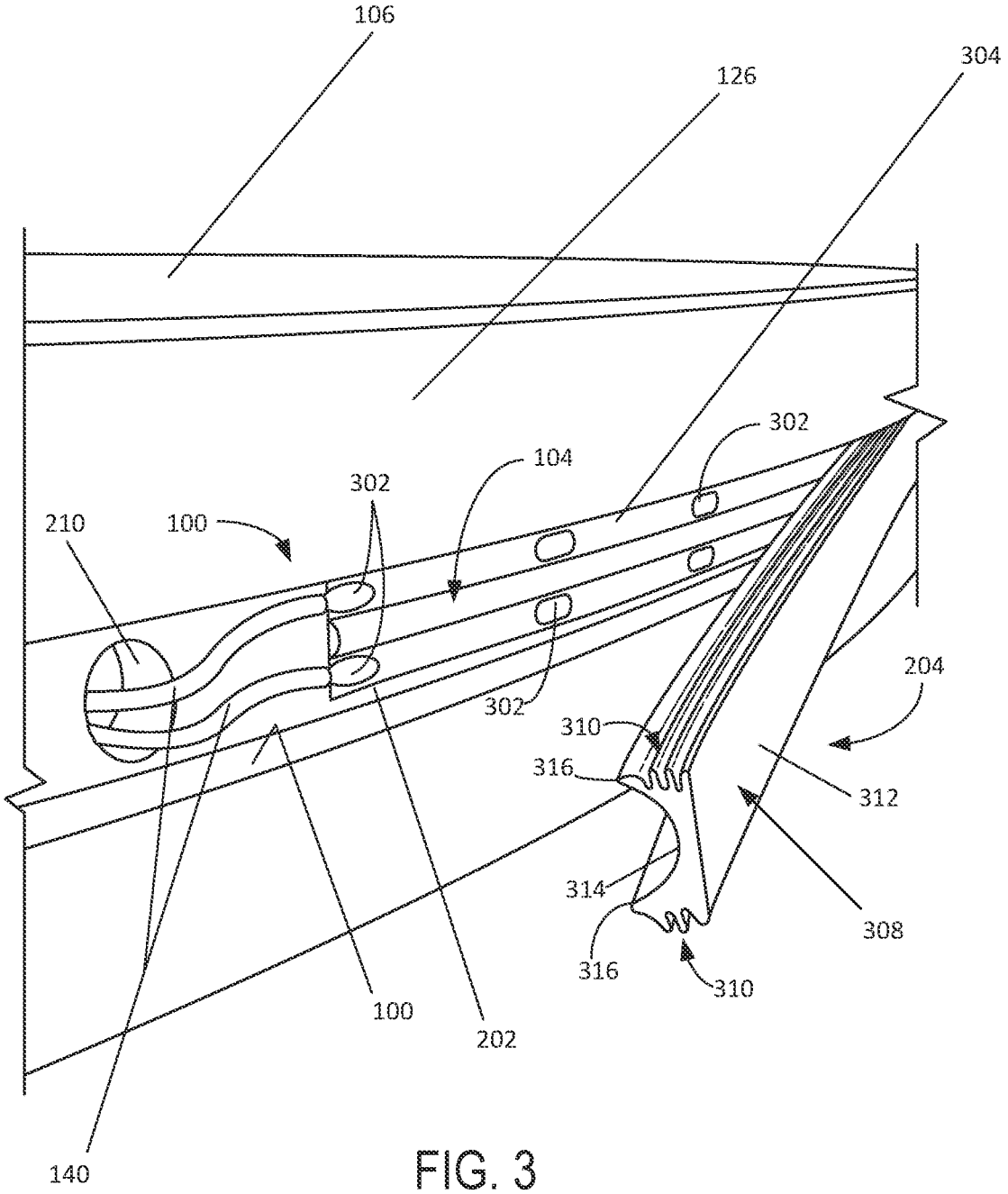
FIG. 3 is a perspective view of another example rotatable shelf illumination system.

FIG. 3 is a perspective view of another example of a rotatable shelf illumination system 100. In FIG. 3, a portion of the lip 126 at the peripheral edge of the rotatable shelf 106 is shown, where the refractive lens 204 is partially pulled away from the groove 202 for illustrative purposes. The one or more light sources 104 may be mounted in the groove 202. In the example of FIG. 3, the one or more lights sources 104 may be light emitting diodes (LEDs, COB LEDs, or OLEDs), and/or electroluminescent material mounted on a flexible circuit board 304 and electrically coupled via the flexible circuit board 304 with termination pads 302. The flexible circuit board 304 may be electrically coupled at termination pads 302 with the conductors 140 extending beyond the exit aperture 210.

In other examples, other types of electrical assemblies and/or constructions may be used, such as wires, power buses, plugs, connectors, or any other form of electrically conductive device or element for electrically connecting the light sources 104 in parallel and/or series to the conductors 140. Although reference is made to the flexible circuit board 304 herein, it should be recognized that other forms of electrical connectivity are contemplated and possible. Features and functionality discussed with reference to FIGS. 1 and 2 are fully compatible and interchangeable with FIG. 3, unless otherwise indicated. Accordingly, for purposes of brevity, the previous discussion will not be repeated, and the further discussion herein will instead highlight features and functionality illustrated in FIG. 3.

In the example of FIG. 3, the flexible circuit board 304 may include one or more light sources 104 mounted on the circuit board 304. The flexible circuit board 304 may be a planar surface having a length greater than a width, and a thickness less than the width. The planar surface of the flexible circuit board 304 includes conductive pads 302 at predetermined intervals, some of which are electrically connected with the conductors 140. The light sources 104 may be, for example, light emitting diodes (LED), chip-on-board (COB) LEDs, OLED or electroluminescent material. The conductive pads 302 may be included on a top planar surface alongside the light sources 104, or on a bottom planar surface of the flexible circuit board 304 on a side of the flexible circuit board 304 that is opposite the planar surface on which the light sources 104 are positioned. In other examples, the conductive pads 302 may be in different locations on one or more of the planar surfaces of the flexible circuit board 304. In the illustrated example, the LED diodes 304 are illustrated as chip-on-board (COB) LEDs providing a continuous light source on the planar surface 116 with conductive pads 302 sequentially spaced along opposing edges of the flexible circuit board 304. In other examples, other configurations/positions of LED diodes 114 and/or electrically conductive pads 302 on the flexible circuit board 304 are possible.

The refractive lens 204 includes a body 308 and the fingers 310. The body 308 includes a planar outer surface 312 to face away from the groove 202 in the rotatable shelf 106, and a cavity 314 facing toward the groove 202. The planar outer surface 312 may generally align with the outer surface of the lip 126, and the cavity 314 may provide a space to receive at least part of the light sources 104. The cavity 314 may also be sized and geometrically formed to refract light emitted by the light sources 104. In examples, the body 308 may include opposing edges 316 forming the cavity 314, that may abut the light sources 104 or related items, such as the opposing edges of the flexible circuit board 304 and hold the light sources 104 in position in the groove 202. The fingers 310 may independently extend away from the body 308 on opposing edges of the body 308 to engage with sidewalls 314 of the groove 202 when the refractive lens 204 is friction fit inside the groove 202 formed in the rotatable shelf 106. The fingers 310 may engage with sidewalls 314 and be forcibly bent toward the planar outer surface 312 of the body 308. Accordingly, once the refractive lens 204 is fully inserted into the groove 202, the fingers 310 may be physically moved into a biased position against the sidewalls 314 to minimize movement radially outward of the refractive lens 204 and the light sources 104. End caps, or end clips, or some other device may be used to cover the ends of the refractive lens 204 in the groove 202.

Figure 4:
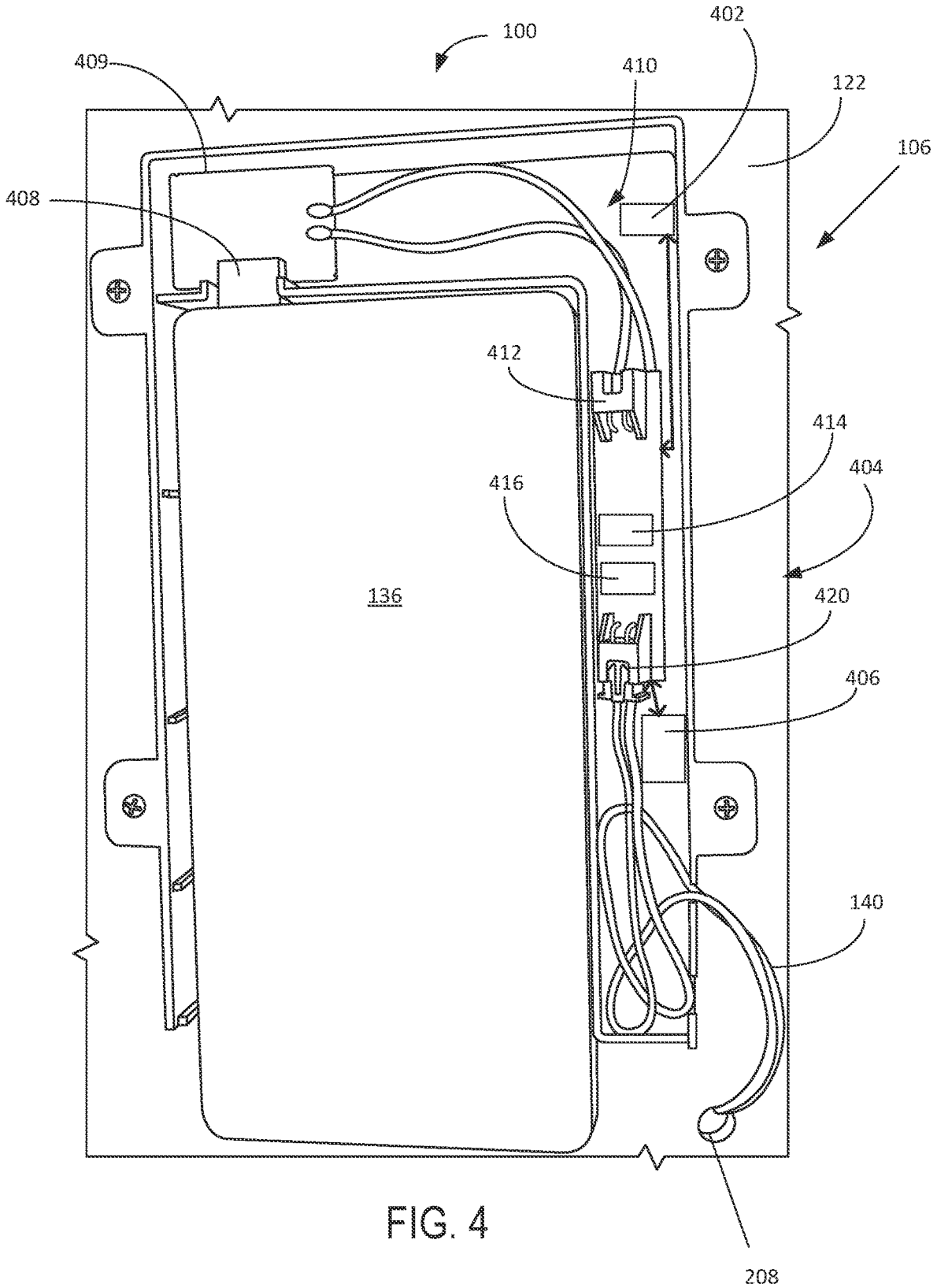
FIG. 4 is a schematic of an example of an electronic enclosure included in the rotatable shelf illumination system of FIG. 1, with a side panel cover removed.

FIG. 4 is a schematic of an example of the electronic enclosure 102 included in the rotatable shelf illumination system 100 with a side panel cover removed for purposes of discussion. In FIG. 4, the electronic enclosure 102 is illustrated as mounted on a portion of the planar surface 122 of the rotatable shelf 106 as illustrated in FIGS. 1-3 with the conductors 140 being routed through the entry aperture 208. Features and functionality discussed with reference to FIGS. 1-3 are fully compatible and interchangeable, unless otherwise indicated. Accordingly, for purposes of brevity, the previous discussion will not be repeated, and the further discussion herein will instead highlight features and functionality illustrated in FIG. 4.

Included in the illustrated electronic enclosure 102 is the rechargeable power supply 136, a power bus 402, a controller circuitry 404 and a magnetic field sensor 406. The power bus 402 and the magnetic field sensor 406 may be separate components in communication with the controller circuitry 404 as illustrated, or may be integral components within the controller circuitry 404. The power bus 402 may receive power from the rechargeable power supply 136, and supply power to the controller circuitry 404 and the magnetic field sensor 406. The power bus 402 may include power conditioning circuitry and conductors. In examples, the power conditioning circuitry of the power bus 402 may include a voltage regulator, a voltage converter, and/or other power conditioning/conversion functionality. In other examples, the voltage regulator, voltage converter, and/or other power conditioning/conversion functionality may be omitted and replaced with electrically conductive materials for electrically connecting the rechargeable power supply 136 with the controller circuitry 404 and the magnetic field sensor 406.

The removable power supply 136 may be electrically coupled with the power bus 402 via a supply connector 408 included on a power circuit board 409. The supply connector 408 may be a detachable connector, such as a male to female connector cable of conducting electric current and voltage. In one example, the supply connector 408 may be a universal serial bus (USB) connector where the male side of the USB is coupled with the power circuit board 409, and the female side of the USB is in the rechargeable power supply 136. In the illustrated example of FIG. 4, the power circuit board 409 is electrically connected with the power bus 402, the controller circuitry 404 and the magnetic field sensor 406 via conductors 410 that are electrically terminated at the power circuit board 409 and a power input connector 412.

The controller circuitry 404 may manage and control the functionality of rotatable shelf illumination system. The controller circuitry 404 may include a processor 414, such as a microprocessor computer executing instructions stored in a memory circuitry 416. In addition, the controller circuitry 404 may include the power bus 402, the magnetic field sensor 406, timers, comparators, input/output circuitry, and/or any other circuitry to perform the functionality described herein.

The magnetic field sensor 406 may be a digital or an analog sensor device. The magnetic field sensor 406 may include a magnetometer for measuring magnetic fields in its surroundings, which may be used to develop a heading or orientation. The magnetic field sensor 406 may provide corresponding magnetic field readings as magnetic field value signals to the controller circuitry 404. For example, the magnetic field sensor 406 may provide "X", "Y" and "Z" magnetic field readings. Based on the magnetic field value signals measured from the magnetic field sensor 406, the controller circuitry 404 may calculate a heading, and establish a rotational position or home position of the rotatable shelf 106. Alternatively, or in addition, in some examples, the magnetic field sensor 406 may be configured to measure magnetic fields, calculate a heading, and determine a rotational position or home position of the rotatable shelf 106 based on the calculated heading. The rotational position or home position of the rotatable shelf 106 may be provided by the magnetic field sensor 406 as the magnetic field value signals to the controller circuitry 404.

The controller circuitry 404 may monitor the magnetic field sensor 406 for rotational position of the rotatable shelf 106. In addition, the controller circuitry 404 may selective energize the light sources 104 for a predetermined period of time in response to changes in a rotational position of the rotatable shelf 106. The controller circuitry 404 may, for example, determine changes in rotational position of the rotatable shelf 106 by reference to an established home position. In other examples, changes in rotational position of the rotational shelf 106 may be determined based on a rotational travel distance, changes in degrees of orientation, a length of time movement is detected or other techniques for detecting an amount of rotational movement of the rotatable shelf 106.

A sensitivity of the controller circuitry 404 and/or magnetic field sensor 406 may be adjusted to detect an amount of rotation of the rotatable shelf 106. For example, the sensitivity may be set to detect a predetermined amount of rotation, such as rotation of no less than a quarter to one half of a full 360 degree rotation of the rotatable shelf 106.

In example implementations, the magnetic field sensor 406 and the controller circuitry 404 may automatically energize, or awaken from a sleep mode, and, upon energization, automatically calibrate to and/or establish a current home position of the rotatable shelf 106 according to magnetic field(s) being sensed. The current home position, or magnetic field values representative thereof, may be communicated from the magnetic field sensor 406 to the controller circuitry 404. Alternatively, or in addition, the controller circuitry 404 may control a sleep mode and an awake mode timing of the controller circuitry 404 and the magnetic field sensor 406. In addition, the controller circuitry 404 may calibrate to a current home position of the rotatable shelf 106 according to the magnetic field(s) being sensed by the magnetic field sensor 406.

In an example, the current home position may be calculated from the magnetic field(s) signal values and stored in the memory circuitry 416 by the processor 414. The processor 414 may, for example, awake from the sleep mode and poll the magnetic field sensor 406 on a predetermined schedule, such as every 2 seconds, to receive the magnetic field signals and confirm the rotational position of the rotatable shelf 106 has not changed by more than a predetermined amount. If the change is less than the predetermined amount, the controller circuitry 404 may go back to sleep mode. If, on the other hand, the change in rotatable position is greater than the predetermined amount, the light sources 104 may be energized.

Once the light sources are energized, the magnetic field sensor 406 may enter sleep mode until it's next event, which may be, for example, a sleep cycle timeout, or a poll message from the controller circuitry 404. The controller circuitry 404 may either stay awake while the light sources 104 are energized, or may return to the sleep mode. In an example, the controller circuitry 404 may energize the light sources 104 and go to sleep mode since there will be no further energization of the light sources until the predetermined energization period ends, such as 15 s, has elapsed. When the light sources 104 time out and should be turned off (deenergized) by the controller circuitry 404, the controller circuitry 404 may calculate a new home position from the values provided by the magnetic field sensor 406 and turn of the light sources 104.

Based on the current home position, the controller circuitry 404 may energize the light sources 104 in response to detection of rotation of the rotatable shelf 106 more than a predetermined amount. The magnetic field sensor 406 may be de-energize, or go back to sleep mode, after a predetermined time in the absence of detection of further rotational movement. In an example, the magnetic field sensor 406 may enter sleep mode and deenergize in response to no change in the magnetic field for a predetermined period of time. Thus, in this example, the controller circuitry 404 and the magnetic field sensor 406 may be on independent sleep cycles. In another example, the controller circuitry 404 may deenergize the magnetic field sensor 406 at a time when the controller circuitry 404 enters a sleep mode.

The magnetic field sensor may be re-energized upon subsequent movement of the rotatable shelf 106, and calibrate to a new current home position. Thus, for example, in the case of a full round rotatable shelf, a new home position may be established each time the magnetic field sensor 406 and the controller circuitry 404 are awakened since there may be no "rest" or "home position" that the rotatable shelf 106 returns to each time after rotation/use. In this situation, in order to meet the need of conserving power, the light sources 104 may be turned off by the controller circuitry 404 after a predetermined time. A new home position may be calculated by the controller circuitry 404 if the rotatable shelf 106 has had sufficient rotational movement to reach or exceed the predetermined threshold and turn on the light sources 104. Rotational movement of the rotatable shelf less than the predetermined amount multiple times may not cause a recalculation of a new home position. The wake/sleep cycle is independent of light sources being on.

In other examples, the controller circuitry 404, or the magnetic field sensor 406 may determine and store a home position, and the controller circuitry 404 may initiate energization of the light sources 104 in response to rotation of the rotatable shelf 106 more than a predetermined amount away from the established home position. In examples, a new home position may be calculated by the controller circuitry 404 if the rotatable shelf has rotated enough to trigger the controller circuitry 404 to turn on the light sources 104. Thus, in these examples, when the rotatable shelf 106 is moved less than the predetermined amount, even multiple times, the controller circuitry 404 may not cause a recalculation of the home position.

The wake/sleep cycle may be independent of the light sources being cycled on and off. In these examples, the controller circuitry 404 may include a sleep mode feature that is initiated when there is limited activity despite not returning to the home position in order to conserve the rechargeable power supply 136. For example, in the case of a kidney shaped rotatable shelf, as illustrated in FIG. 1, the rotatable shelf 106 may need to be rotated to the stored home position in order to close the cabinet door. In some instances, the LEDs should still be deenergized to conserve power if, for example, the rotatable shelf is not returned to the stored rest position and the cabinet door is left open.

In another example, the rotatable shelf may instead be a slideable drawer, and the magnetic field sensor 406 may be used, or replaced with an accelerometer sensor to identify when the drawer is moved from a closed to an open position. In this example, the light sources may be mounted inside the drawer. Upon the controller circuitry sensing slidable movement of the drawer beyond a predetermined distance, the light sources 104 may be energized to illuminate the interior of the drawer.

The rotatable shelf illumination system 100 is designed for low power consumption operation to ensure long life of the rechargeable power supply 136. In this regard, the controller circuitry 404 may include a sleep mode, which the controller circuitry 404 may automatically enter after a predetermined period of inactivity, such as 15 seconds. Upon entry into the sleep mode, the magnetic field sensor 406 may also be deenergized by the controller circuitry 404. Once the controller circuitry 404 has deenergize the light sources 104 and entered the sleep mode after a predetermined time to conserve power consumption, the controller circuitry 404 may still awaken, and monitor for the change in rotational orientation of the rotatable shelf 106. Upon detection of a change in rotational orientation of the rotatable shelf 106 by greater than a predetermined amount, the controller circuitry 404 may come awake, perform calibration and energize the light sources 104.

In examples, the magnetic field sensor 406 may be awakened and polled by the controller circuitry 404 on a predetermined schedule, such as every two seconds, to confirm there has been no orientation change of the rotatable shelf 106. Alternatively, or in addition, the magnetic field sensor 406 may automatically awaken and automatically transmit an orientation update signal to the controller circuitry 404 on a predetermined schedule, which may awaken the controller circuitry 404 when the orientation changes by more than a threshold amount. Alternatively, or in addition, the magnetic field sensor 406 may automatically transmit an orientation update signal to the controller circuitry 404 when awakened by the controller circuitry 404. Alternatively, or in addition, the magnetic field sensor 406 may automatically transmit an orientation update signal to the controller circuitry 404 only when there is a change in orientation of the rotatable shelf 106 above a predetermined threshold. Accordingly, in some examples, the magnetic field sensor 406 may be used to control when the controller circuitry 404 is awakened.

The controller circuitry 404 may be electrically connected with the light sources 104 via a power output connector 420. The power output connector 420 may provide a connection point for the conductors 140 routed through the entry aperture 208 and electrically connected with the light sources 104. In other examples, the connector 420 may be rotated ninety degrees to exit the electronic enclosure housing 102.

Figure 5:
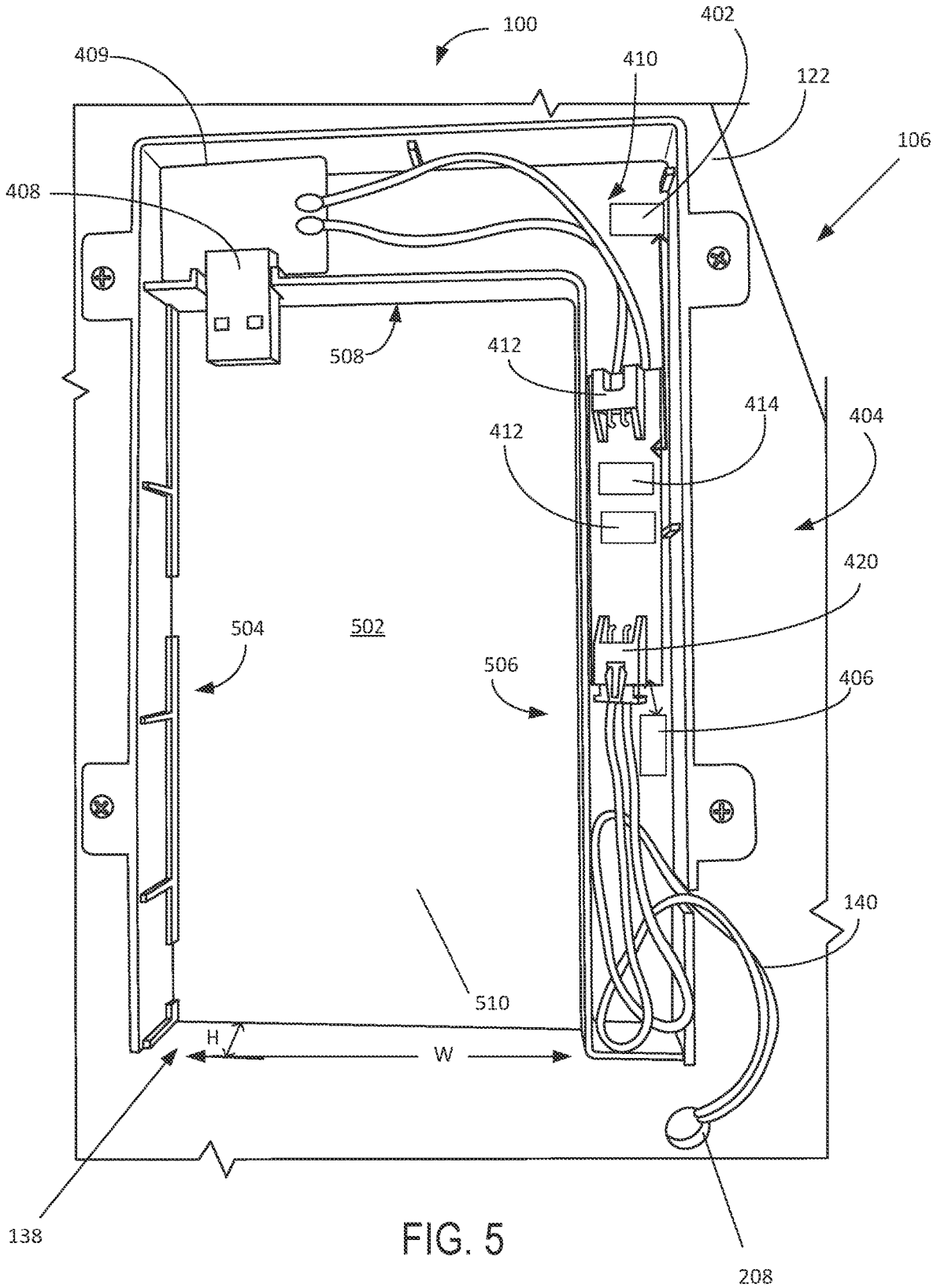
FIG. 5 is an example of an electronic enclosure included in the rotatable shelf illumination system of FIG. 1, with a side panel cover and a rechargeable power supply removed.

FIG. 5 is an example of an electronic enclosure 102 included in the rotatable shelf illumination system 100, with a side panel cover and a rechargeable power supply removed. In FIG. 5, the electronic enclosure 102 is illustrated as mounted on a portion of the planar surface 122 of the rotatable shelf 106 as illustrated in FIGS. 1-4 with the conductors 140 being routed through the entry aperture 208. Features and functionality discussed with reference to FIGS. 1-3 are fully compatible and interchangeable, unless otherwise indicated. Accordingly, for purposes of brevity, the previous discussion will not be repeated, and the further discussion herein will instead highlight features and functionality illustrated in FIG. 5.

As illustrated in FIG. 5, the electronic enclosure 102 may include a power supply bay 502. The power supply bay 502 may form the slot 138 and be sized to receive the rechargeable power supply 136. In addition, the power supply bay 502 may include guide rails 504 opposite an alignment wall 506. The guide rails 504 and the alignment wall 506 are spaced apart by a predetermined distance to receive and align the rechargeable power supply 136 with the supply connector 408. The supply connector 408 may be rigidly positioned in a predetermined location in the power supply bay 502 coupled with the power circuit board 409 for additional robustness.

A header wall 508 may provide a stop for the rechargeable power supply 136 when fully inserted into the slot 138. The outer walls of the electronic enclosure 102 may also align the rechargeable power supply 136 in the power supply bay 502. Although removed for purposes of illustration, the side panel cover is an outer wall of the electronic enclosure 102 and is positioned a predetermined distance from the opposite outer wall 510 to create a height (H) of the slot 138. Thus, a width (W) of the slot 138 is created between the guide rails 504 and the alignment wall 504 and the height of the slot 138 is provided by the opposing outer walls of the electronic enclosure. Once the rechargeable power supply 136 is received in the slot 138, the supply connector 408 of the rechargeable power supply 136 is slideably guided between the guide rails 504 and the alignment wall 504 into electrical connection with supply connector 408.

Figure 6:
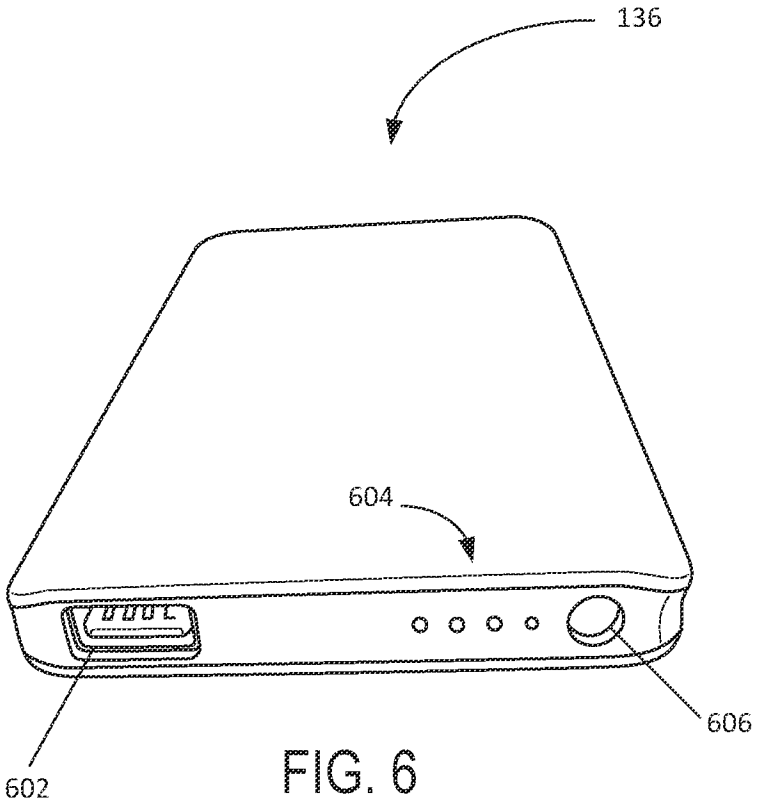
FIG. 6 is perspective view of an example of a rechargeable power supply included in the rotatable shelf illumination system.

FIG. 6 is perspective view of an example of the rechargeable power supply 136 included in the rotatable shelf illumination system 100. The rechargeable power supply 136 includes a power connector 602, charge indications 604 and a power indicator 606. The power connector 602 may align with the supply connector 408 when the rechargeable power supply 136 is inserted through the slot 138 into the power supply bay 502. In the illustrated example, the power connector 602 is a female USB connection and the supply connector 408 is a male USB connector. In other examples, any other form of connector may be used that allows for a friction fit electrical connection when the rechargeable power supply 136 is inserted through the slot 138 and manually slid into the power supply bay 502. The charge indications 604 may be a series of LEDs indicating the percentage charge of the rechargeable power supply 136. In the illustrated example, indications of percentage charge are provided as 25%, 50%, 75% and 100% charged. The power indicator 606 may indicate that rechargeable power supply 136 is energized. The power indicator 606 may also be used as a light source.

Figure 7:
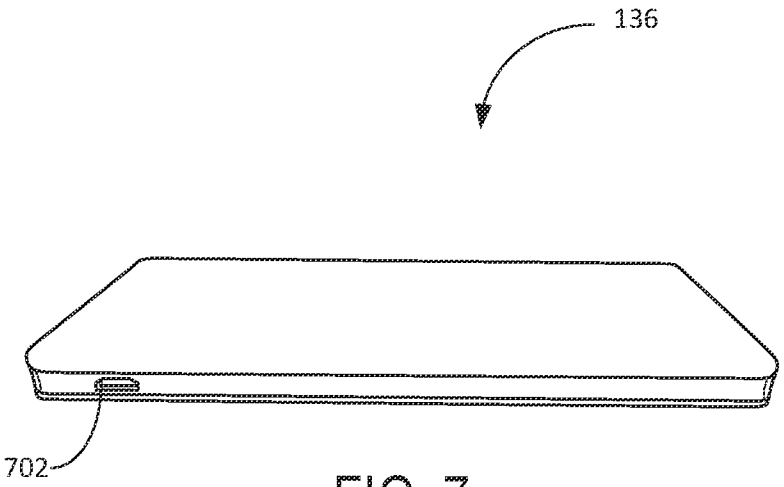
FIG. 7 is a side perspective view of an example of a rechargeable power supply included in the rotatable shelf illumination system.

FIG. 7 is a side perspective view of an example of the rechargeable power supply 136 included in the rotatable shelf illumination system 100. The rechargeable power supply 136 includes a supply power connector 702 for recharging from a power source, such as 5 v DC. The supply power connector 702 may be, for example, a USB-C, micro-USB, or some other form of connector that can be connected with a supply of 5 v DC. As illustrated in FIGS. 6 and 7, the rechargeable power supply 136 includes planar top, bottom and side outer surfaces to align with the slot 138. In addition, the rechargeable power supply 136 includes rounded corners and smooth surfaces to facilitate insertion.

Figure 8:
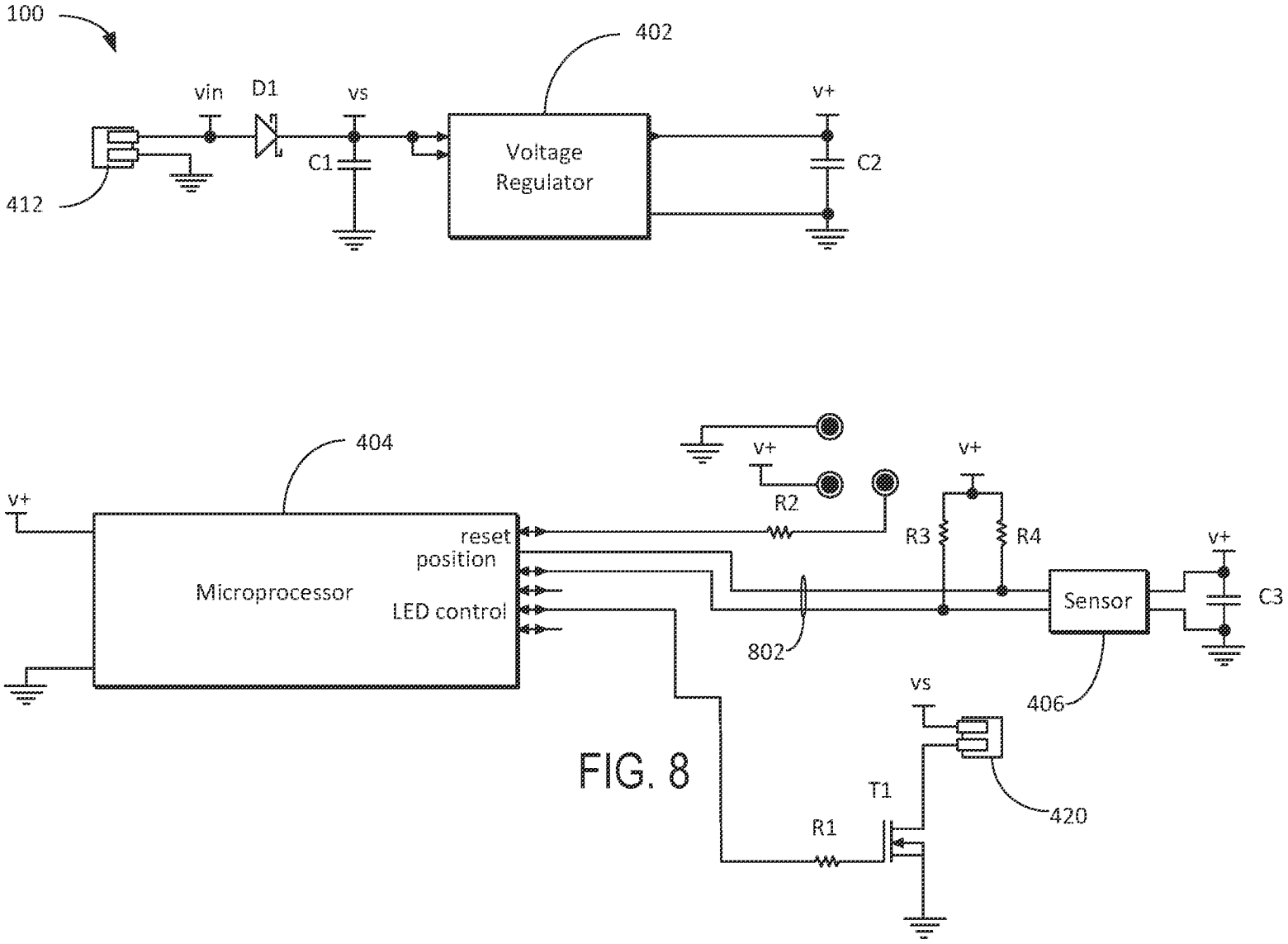
FIG. 8 is a circuit schematic of an example of the rotatable shelf illumination system.

FIG. 8 is a circuit schematic of an example of the rotatable shelf illumination system 100. In FIG. 8, power is supplied to the power bus 402 via supply connector 412. The power bus 402 includes diode D1, and capacitor C1 providing filtering for high frequency anomalies. The supply voltage v+ output by the power bus 402 may be a regulated supply voltage, which is filtered by capacitor C2 and supplied to the controller circuitry 404 and the magnetic field sensor 406. In the example of FIG. 8, the magnetic field sensor 406 provides position information, such as magnetic field values, to the controller circuitry 404 on a position line 802. Position line 802 may carry a predetermined communication protocol, such as $I^2C$. In other examples, the magnetic field values may be transmitted with other protocols or as a digital or analog signal. The controller circuitry 404 may be reset manually via a reset line 804.

In addition, the controller circuitry 404 may control energization and de-energization of the light sources 104 304 via a transistor switch T1, which selectively supplies supply voltage (vs) via the power output connector 420 when energized by the controller circuitry 404. In examples with multiple independently controlled light sources 104, multiple independent operable transistor switches may be used. Alternatively, or in addition, where a color of the light sources 104 may be changed by a user, for example, additional transistor switches may be implement to control each respective color. Also, the light sources 104 may be dimmable by the controller circuitry 404 may adjusting transistor switch T1 accordingly to pass less or more current to the light sources 104.

Referring to FIGS. 1-8, the rotatable shelf illumination system 100 may provide a rechargeable power source, such as a battery power source, rotatable shelf illumination system with capability to remove and recharge the power source. The light sources 104 may be installed in a recessed groove 202 in the circumferentially surrounding lip 126 of a rotatable shelf 106 to fully illuminate the interior of a cabinet 108 when energized. Energization of the light sources 104 may occur upon rotation of the rotatable shelf 106. The controller circuitry 404 and the magnetic field sensor 406 may cooperatively operate to energize the light sources 104 when rotational movement or re-positioning of the moveable shelf 106 is detected.

The system 100 may operate efficiently by powering down the controller circuitry 404 and the magnetic field sensor 406 to a sleep mode after a predetermined time of the rotatable shelf 106 not being used. The controller circuitry 404 and/or the magnetic field sensor 406 may remain in a sleep mode until use of the rotatable shelf 106 is detected. Upon detection of use, the controller circuitry 404 and the magnetic field sensor 406 may power up in an awake mode, automatically calibrate to the rotational position of the rotatable shelf 106, and determined if energization of the light sources 104 is warranted. Energization and de-energization of the light sources 104 may be based on changes in orientation of the rotatable shelf 106.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

The methods, devices, processing, circuitry, and logic described above may be implemented in many different ways and in many different combinations of hardware and software. For example, all or parts of the implementations may be circuitry that includes an instruction processor, such as a Central Processing Unit (CPU), microcontroller, or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Accordingly, the circuitry may store or access instructions for execution, or may implement its functionality in hardware alone. The instructions may be stored in memory circuitry that includes a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed. For instance, the circuitry may include multiple distinct system components, such as multiple processors and memories, and may span multiple distributed processing systems. Parameters, databases, and other data structures may be separately stored and managed, may be incorporated into a single memory or database, may be logically and physically organized in many different ways, and may be implemented in many different ways. Example implementations include linked lists, program variables, hash tables, arrays, records (e.g., database records), objects, and implicit storage mechanisms. Instructions may form parts (e.g., subroutines or other code sections) of a single program, may form multiple separate programs, may be distributed across multiple memories and processors, and may be implemented in many different ways. Example implementations include stand-alone programs, and as part of a library, such as a shared library like a Dynamic Link Library (DLL). The library, for example, may contain shared data and one or more shared programs that include instructions that perform any of the processing described above or illustrated in the drawings, when executed by the circuitry.

In some examples, each unit, subunit, and/or module of the system may include a logical component. Each logical component may be hardware or a combination of hardware and software. For example, each logical component may include an application specific integrated circuit (ASIC), a Field Programmable Gate Array (FPGA), a digital logic circuit, an analog circuit, a combination of discrete circuits, gates, or any other type of hardware or combination thereof. Alternatively or in addition, each logical component may include memory hardware, such as a portion of the memory, for example, that comprises instructions executable with the processor or other processors to implement one or more of the features of the logical components. When any one of the logical components includes the portion of the memory that comprises instructions executable with the processor, the logical component may or may not include the processor. In some examples, each logical components may just be the portion of the memory or other physical memory that comprises instructions executable with the processor or other processor to implement the features of the corresponding logical component without the logical component including any other hardware. Because each logical component includes at least some hardware even when the included hardware comprises software, each logical component may be interchangeably referred to as a hardware logical component.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

We claim:

1. A rotatable shelf illumination system comprising:

an electronics enclosure mountable on a rotatable shelf in a cabinet;

a series of sequentially mounted light sources, the light sources mountable in a groove formed around a circumferential edge of the rotatable shelf and electrically coupled with a rechargeable power supply included in the electronics enclosure; and a refractive lens mountable in the groove formed around the circumferential edge of the rotatable shelf as a cover over the light sources.

2. The rotatable shelf illumination system of claim 1, further comprising a magnetic field sensor included in the electronics enclosure and powered by the rechargeable power supply, the magnetic field sensor configured to measure a magnetic field used to determine a heading or orientation for a plurality of different rotational positions of the rotatable shelf.

3. The rotatable shelf illumination system of claim 2, further comprising a controller circuitry included in the electronics enclosure and powered by the rechargeable power supply, the controller circuitry configured to monitor the magnetic field sensor for the plurality of different rotational positions of the rotatable shelf and the controller circuitry further configured to energize the light sources with the rechargeable power supply for a predetermined period of time in response to changes between the rotational positions of the rotatable shelf being greater than a predetermined amount of rotation.

4. The rotatable shelf illumination system of claim 3, wherein a sensitivity of the controller circuitry to detect the predetermined amount of rotation of the rotatable shelf and energize the light sources is adjustable.

5. The rotatable shelf illumination system of claim 3, wherein the magnetic field sensor and the controller circuitry are configured to automatically awaken from a sleep mode upon detection of motion, and calibrate to a first one of the rotational positions as a current home position of the rotatable shelf, the controller circuitry configured to energize the light sources in response to rotation of the rotatable shelf to a second one of the rotational positions greater than a predetermined amount from the current home position.

6. The rotatable shelf illumination system of claim 5, wherein the magnetic field sensor and the controller circuitry are further configured to return to the sleep mode after a predetermined time, the magnetic field sensor and the controller circuitry further configured to re-awaken, in response to subsequent movement of the rotatable shelf to a third one of the rotational positions, and re-calibrate the third one of the rotational positions as a new current home position.

7. The rotatable shelf illumination system of claim 1, further comprising a magnetic field sensor and a controller circuitry configured to determine and store a home position, the controller circuitry further configured to energize the light sources in response to rotation of the rotatable shelf by more than a predetermined amount of rotation away from the home position.

8. The rotatable shelf illumination system of claim 1, wherein the rechargeable power supply is an energy storage battery removably inserted in the electronics enclosure to supply a power bus, the energy storage battery being a rechargeable battery that is removeable from the electronics enclosure for recharging.

9. The rotatable shelf illumination system of claim 1, wherein the refractive lens is friction fit in the groove formed in the rotatable shelf.

10. The rotatable shelf illumination system of claim 1, wherein the refractive lens comprises a body and a plurality of fingers independently extending away from the body on opposing edges of the body.

11. The rotatable shelf illumination system of claim 1, further comprising a controller circuitry and a magnetic field sensor included in the electronics enclosure, the controller circuitry configured to selectively energize and de-energize the light sources with the rechargeable power supply according to a plurality of rotational orientation positions of the rotatable shelf, each of the plurality of rotational orientation positions determined by the controller circuitry based on a magnetic field detected by the magnetic field sensor at each of the plurality of rotational orientation positions.

12. A rotatable shelf illumination system comprising:

a rechargeable power supply removeable installed in an electronics enclosure, the electronics enclosure mountable on a rotatable shelf;

a light source mountable on the rotatable shelf and electrically coupled with the rechargeable power supply;

a refractive lens mountable on the rotatable shelf to cover the light source;

a controller circuitry included in the electronics enclosure, the controller circuitry configured to selective energize the light source in response to a change in rotational orientation of the rotatable shelf; and a magnetic field sensor in communication with or included in the controller circuitry, the magnetic field sensor configured to measure a magnetic field at any one of a plurality of different rotational positions of the rotatable shelf and the controller circuitry configured to determine the different rotational positions of the rotatable shelf based on the magnetic field, and determine the change in rotational orientation of the rotatable shelf is greater than a predetermined amount based on a difference between two of the determined different rotational positions.

13. The rotatable shelf illumination system of claim 12, wherein the rechargeable power supply is an energy storage battery that is slidably received in the electronics enclosure via a slot formed in the electronics enclosure, the rechargeable power supply being slidably removable from the electronics enclosure for recharging.

14. The rotatable shelf illumination system of claim 12, wherein the controller circuitry is configured to deenergize the light source and enter a sleep mode after a predetermined time to conserve power consumption, the controller circuitry configured to monitor for the change in rotational orientation of the rotatable shelf during the sleep mode, and come awake upon detection of the change in rotational orientation of the rotatable shelf being greater than a predetermined amount.

15. A rotatable shelf illumination system comprising:

a rotatable shelf for a cabinet, the rotatable shelf having a central aperture for coaxial coupling with a central post included in the cabinet, the rotatable shelf radially extending away from the central aperture to an outer edge of the rotatable shelf, the outer edge comprising a groove circumferentially extending around at least part of the outer edge;

a light source disposed in the groove, wherein the groove is sized to receive the light source such that the light source is recessed into the outer edge of the rotatable shelf;

an electronics enclosure mounted on the rotatable shelf, the electronics enclosure comprising a rechargeable power supply electrically coupled with the light source in the groove; and a refractive lens mounted in the groove to cover the light source.

16. The rotatable shelf illumination system of claim 15, wherein the groove is formed in a lip circumferentially surrounding a planar surface of the rotatable shelf, the planar surface extending radially between the central aperture and the lip, and the lip abutting the planar surface and extending perpendicular to the planar surface.

17. The rotatable shelf illumination system of claim 16, wherein the groove is formed in a radially outward surface of the lip, or a radially inward surface of the lip.

18. The rotatable shelf illumination system of claim 15, further comprising a conductor extending from the electronic enclosure through an entry aperture in a planar surface of the rotatable shelf where the electronics enclosure is mounted, and extending through an exit aperture in the groove to the light source in the groove.

19. The rotatable shelf illumination system of claim 15, wherein a portion of the rechargeable power supply extends outside the electronics enclosure through an aperture in the electronic enclosure, and the electronics enclosure is positioned on a planar surface of the rotatable shelf to align the portion of the rechargeable power supply extending out of aperature in the electronic enclosure with the outer edge.

20. The rotatable shelf illumination system of claim 15, the shelf bi-directionally horizontally rotatable about a central axis of the central aperture, and further comprising a magnetic sensor to detect an amount of rotation of the shelf around the central axis based on a magnetic field surrounding the shelf.

21. The rotatable shelf illumination system of claim 20, wherein the magnetic sensor is a magnetometer.

* * * * *